United States Patent [19]

Narcum

[11] 4,334,641

[45] Jun. 15, 1982

[54] ADJUSTABLE HANGER

[76] Inventor: William Narcum, 2303 Grove La., Cary, Ill. 60013

[21] Appl. No.: 122,579

[22] Filed: Feb. 19, 1980

[51] Int. Cl.[3] ..... A47J 51/13

[52] U.S. Cl. ..... 223/94; 211/118; D6/250

[58] Field of Search ..... 223/85, 89, 92, 94; 211/118, 119; D6/250

[56] References Cited

U.S. PATENT DOCUMENTS

| | | | |
|---|---|---|---|
| 2,491,836 | 12/1949 | Simmet | 223/89 |
| 2,500,817 | 3/1950 | Glassmeyer | 223/89 |

FOREIGN PATENT DOCUMENTS

| | | | |
|---|---|---|---|
| 1090684 | 10/1954 | France | 223/89 |
| 468591 | 1/1952 | Italy | 223/94 |
| 456084 | 7/1968 | Switzerland | 223/85 |

*Primary Examiner*—Robert Mackey
*Attorney, Agent, or Firm*—Terry R. Mohr

[57] ABSTRACT

An adjustable garment hanger comprised of four (4) main wire members, which include a support member, two extensible angle members and a connecting rod. Each of the angle members is adjustably attached to both the support member and to the connecting rod by duplex sleeve connectors. The support member includes a suspension hook portion and has formed thereon a pair of downwardly diverging legs, which form an angle substantially the same as the angle of a neck and shoulder portion of a garment. Each duplex sleeve connector is identical in construction and is substantially "S" shaped so as to form two loop portions. Each end of the diverging legs and each end of the connecting rod have one loop portion of the sleeve connector securely attached thereto so as to not allow any movement thereon. Each of the angle members are substantially "V" shaped so as to have two arm portions. Each arm portion of each angle member is slidably embraced by the second loop portion of each sleeve connector so that each angle member may be moved relative to or from one another, and thus form an adjustable hanger that may be either reduced or enlarged from a conventional size to any desired adjustment within the structural limits of the hanger.

5 Claims, 2 Drawing Figures

FIG.1
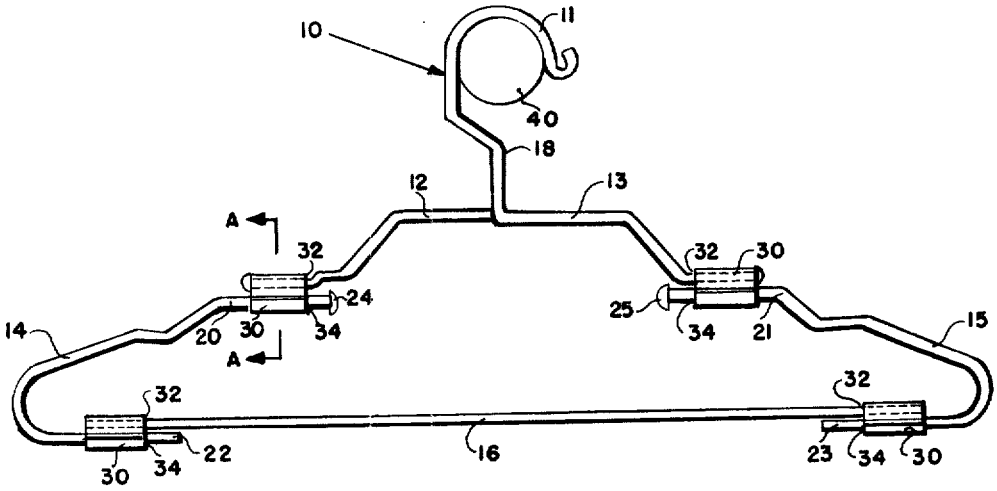
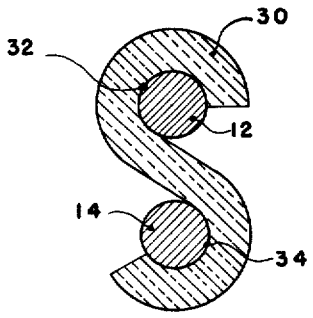
Section "A-A"
FIG. 2

ADJUSTABLE HANGER

BACKGROUND OF THE INVENTION

1. Field of the Invention

This invention relates generally to a garment hanger and more particularly to an adjustable garment hanger formed of wire, the adjustable portions of which are slidably attached by sleeve connectors which permit the hanger to be materially adjusted in size to accomodate garments of different sizes.

2. Description of the Prior Art

Heretofore, various methods have been employed for adjusting the size of garment hangers, some of which have been formed by telescoping tubes which provide adjusting means and others which have certain sections of the hanger formed to provide loops by which the sections are adjustably held together. Exemplary adjustable hangers of this type are described and illustrated in U.S. Pat. Nos. 2,500,817, issued Mar. 14, 1950; to LaTrelle B. Glassmeyer; 2,549,500, issued Apr. 17, 1951 to Lawrence W. McClaim; 2,354,099 issued July 18, 1944 to C. G. Bess; 2,360,119, issued Oct. 10, 1944 to W. M. Gallagher, and 2,682,978, issued July 6, 1954 to M. M. Brock. These adjustable hangers have been found to be expensive in their construction. Still others have been constructed of materials that caused the hanger to become misshappen and distorted and which in turn causes the garment to hang out of its normal shape.

SUMMARY OF THE INVENTION

It is an object of the present invention to provide a garment hanger having a frame composed of wire, metallic rod or plastic and which is formed in sections whereby each of the sections may be slidably secured together to provide means for adjusting the size of the hanger.

It is another object of the present invention to provide a hanger formed in sections whereby the sections are slidably secured together by a duplex sleeve connector.

It is still a further object of the present invention to provide an adjustable garment hanger which is of a simple and economical construction.

Still another object of the invention is to provide a hanger which is adjustable in order to accomodate or fit a wide variety of garments. It is a further object of the present invention to provide an adjustable garment hanger wherein the operations needed to adjust the hanger to varying sizes are simple and readily performed without the need of special tools, and are of such a nature that unskilled persons who would be expected to use such hangers will be able to adjust the same readily and without special instructions and expertise.

The foregoing and other objects are realized in accordance with the invention by providing an adjustable hanger comprised of four (4) main wire members, which include a support member, two (2) extensible angle members, and a connecting rod. Each of the angle members are adjustably attached to both the support member and to the connecting rod by duplex sleeve connectors so that each angle member may be moved relative to or from one another and thus form an adjustable hanger that may be reduced or enlarged from a conventional size.

BRIEF DESCRIPTION OF THE DRAWINGS

FIG. 1 is a face view of an adjustable garment hanger embodying the features of the present invention;

FIG. 2 is a sectional view taken on line A—A of the duplex sleeve connector illustrated in FIG. 1.

DESCRIPTION OF THE PREFERRED EMBODIMENT

Referring now to the drawings, an adjustable garment hanger embodying the preferred features of the present invention is illustrated at 10. The adjustable garment hanger 10 is comprised of four main wire members, which include a support member 18, two extensible angle members 14 and 15, and a connecting rod 16. Each angle member 14, 15 is adjustably attached to both the support member 18 and to the connecting rod 16 by duplex sleeve connectors 30. Each duplex sleeve connector 30 is identical in construction and is substantially "S" shaped so as to form a pair of loop portions 32, 34. The loop portions 32 are securely attached to the support 18 and to the connecting rod 16 so as not to allow any movement thereon. The angle members 14 and 15 have oblique arms 20, 21 and base arms 22, 23, respectively, that are slidably embraced by the loop portion 34 of each of the sleeve connectors 30 so that each angle member may be moved relative to or from one another and thus construct an adjustable hanger.

In considering the adjustable garment hanger 10 in more detail, the support member includes a suspension hook portion 11 which is an intregal formation of support member 18 and which has the obvious function of allowing the garment hanger 10 to hang or be suspended from any type of support means such as a rod 40. At the base of suspension hook portion 11, support member 18 has a pair of downwardly diverging legs 12, 13 which have each end thereof constructed so that said end is parallel to the horizontal access of garment hanger 10. The downwardly diverging legs 12, 13 form an angle substantially the same as the angle of a neck and shoulder portion of a garment.

Each duplex sleeve connector 30 is identical in construction and is substantially "S" shaped so as to form a pair of loop portions 32, 34 which are designed to securely attach to legs 12, 13 and to each end of the connecting rod 16. The attachment of loop portions 32 to the described members can be accomplished in a variety of ways such as clamping or crimping or if necessary, by a spot weld.

The angle members 14 and 15 are identical in construction and are substantially "V" shaped so that each has formed thereon two arm portions 20, 22 and 21, 23, respectively. The end portions of each leg 20, 21 are formed so that they are parallel to legs 22, 23 which in turn are parallel to the horizontal axis of garment hanger 10. The end portions of each oblique arm 20, 21 are slidably embraced by the loop portion 34 of the sleeve connectors 30 attached to legs 12, 13, respectively. In addition, the base arms 22, 23 are slidably embraced by the loop portions 34 of the sleeve connectors 30 attached at each end of connecting rod 16. The arm portions 20, 21, 22 and 23 are so embraced by loop portions 34 so that each angle member 14, 15 may be moved relative to or from one another simultaneously and thus form a hanger which may be either reduced or enlarged from a conventional size to any desired adjustment within the structural limits of the hanger. The hanger 10 may be firmly held in any desired position as the frictional pressure imposed by loop portions 34 on arm portions 20, 21, 22 and 23 is just sufficient to allow relative movement when a moderate amount of manual force is imposed upon angle members 14, 15.

Stop portions 24 and 25 are formed on the ends of oblique arms 20, 21, respectively, and are in the nature of an enlarged portion of each wire member and each of which constitutes a brake when angle members 14, 15 are extended to their outermost positions.

The radial configuration between oblique arm 20 and base arm 22 as well as oblique arm 21 and base arm 23 forms a frictional stop when angle members 14, 15 are forced to their innermost positions.

The embodiment described herein is only an example and could be modified, especially by substitution of different construction material, without thereby departing from the scope of the invention as defined in the claims.

I claim:

1. An adjustable garment hanger comprising, in combination, a support member including a suspension hook portion, a pair of angle members attached to said support member, and a connecting rod attached to said angle members, wherein:

(a) said pair of angle members is movable relative to or from one another;

(b) each of said angle members is adjustably attached to said support member and said connecting rod by a duplex sleeve connector;

(c) each of said angle members has an oblique arm and a base arm wherein said oblique arm is attached to said support member and said base arm is attached to said connecting rod;

(d) an end portion of said oblique arm is parallel to said base arm and parallel to a horizontal axis of said hanger; and (e) and said support member, said connecting rod, and said angle members are in substantially the same plane.

2. In the garment hanger of claim 1 wherein said duplex sleeve connectors are each identical in shape, and are formed in a substantially "S" configuration so as to have two loop portions.

3. In the garment hanger of claim 1 wherein said support member further comprises a pair of downwardly diverging leg members.

4. In the hanger of claim 3, (a) a second portion of said oblique arm being parallel to said end portion; and (b) said end portion and said second portion being separated by an angle section.

5. An adjustable garment hanger comprising a support member, a pair of angle members slidably connected to said support member, and a connecting rod slidably connected to said angle members, wherein:

(a) said support member is comprised of a suspension hook portion and a pair of downwardly diverging leg members which form an angle substantially the same as an angle of a neck and shoulder portion of a garment;

(b) a first set of duplex sleeve connectors, said sleeve connectors being formed in a substantially "S" configuration so as to have two loop portions, a first loop portion of said sleeve connector being fixedly attached to each of said leg members of said support member;

(c) each of said pair of angle members being substantially "V" shaped so as to form two arm members, one end of a first arm member of said angle member being slidably engaged in a second loop portion of said sleeve connectors;

(d) said connecting rod being slidably engaged with said angle members by having each end of said connecting rod fixedly attached to one loop portion of a second set of duplex sleeve connectors, and the second loop portion of each of said duplex sleeve connectors being slidably engaged with a second arm member of each of said angle members further wherein:

(i) said first arm member being an oblique arm and second arm member being a base arm;

(ii) an end portion of said oblique arm being substantially parallel to said base arm and substantially parallel to a horizontal axis of said hanger;

(iii) said oblique arm having a second portion substantially parallel to said end portion;

(iv) said second portion and said end portion being separated by an angle portion; and (v) said angle members, said support member, and said connecting rod being substantially co-planar; and (e) a stopping means for limiting movement on each of said angle members.

* * * * *